United States Patent [19]

Boyd

[11] Patent Number: 4,934,006

[45] Date of Patent: Jun. 19, 1990

[54] WATERBED WAVE DAMPENING BATT AND METHOD

[76] Inventor: Dennis Boyd, 14457 Rouge River, Chesterfield, St. Louis County, Mo. 63017

[21] Appl. No.: 174,230

[22] Filed: Mar. 28, 1988

[51] Int. Cl.[5] ..... A47C 27/08

[52] U.S. Cl. ..... 5/750; 156/62.4; 156/308.2; 264/122; 428/74; 428/288; 428/286; 428/247; 428/347; 428/398; 5/451

[58] Field of Search ..... 5/450, 451; 428/288, 428/296, 297, 74, 397, 398; 156/308.2, 62.4; 264/122

[56] References Cited

U.S. PATENT DOCUMENTS 4,668,562 5/1987 Street ..... 428/210

4,672,701 6/1987 Koeses ..... 428/288

*Primary Examiner*—James J. Bell

*Attorney, Agent, or Firm*—Frank B. Janoski

[57] ABSTRACT

A wave dampening batt for use inside a waterbed mattress is made by intimately mixing a multiplicity of short, non-woven fibers of a first type and a multiplicity of short, non-woven thermal bonding fibers. Raising the temperature of the mixture of fibers above the melting point of the thermal bonding fibers yet below the melting point of the fibers of the first type and then lowering the temperature below that melting point causes the thermal bonding fibers to join the fibers of the first type together throughout the wave dampening batt. A waterbed mattress having a batt made in accordance with this method is also disclosed. The fibers of the first type may be solid or hollow with closed ends, the hollow fibers with closed ends providing buoyancy for the batt. The fibers of the first type may also be lobed or unlobed, the lobed fibers having improved resiliency so that the batt recovers more of its thickness after compression than a batt made of unlobed fibers of comparable size and denier.

22 Claims, 1 Drawing Sheet

WATERBED WAVE DAMPENING BATT AND METHOD

BACKGROUND OF THE INVENTION

This invention relates to wave dampening devices for waterbed mattresses and more particularly to fibrous wave dampening batts for dampening the propagation of waves along the upper surfaces of such mattresses.

At present waterbed mattresses are available with a wave dampening layer of fibrous material disposed along the upper surface of the mattress inside the mattress shell. This layer is typically made of short, non-woven polyester fibers bonded together by a resin. This resin is able to penetrate the fibrous batt only to a depth of one inch or so from each side, so that layers formed in this manner are limited to a thickness of approximately two inches. If a thicker batt is desired, it is necessary to mechanically join two or more of the thinner, two-inch layers together by riveting, sewing or the like. Each of these multiple layers must be cut to the proper size after the resin is added.

In addition, polyester does not float in water, so it is necessary to attach buoyant material to the polyester batt in some manner to cause the batt to be positioned properly at the top of the mattress. This, of course, also increases the cost of the wave dampening batt.

At present, waterbed mattresses are shipped to the customer with the wave dampening batt in place inside the mattress. To reduce the bulk of the mattress, the interior of the mattress is put under vacuum. This compresses the fibrous wave dampening batt substantially. Upon removal of the vacuum and inflation of the mattress with water, the fibrous batt recovers only a portion of its pre-compression thickness. This is undesirable since the wave-dampening properties of the batt are directly related to the thickness of the batt.

SUMMARY OF THE INVENTION

Among the various objects and features of the present invention may be noted the provision of a wave-dampening batt for a waterbed mattress with a reduced cost of manufacture.

Another object is the provision of such a batt with improved resiliency.

A third object is the provision of an improved method of making such a batt which makes possible much thicker batts without correspondingly high labor costs.

A fourth object is the provision of such a batt with improved means for providing buoyancy.

Other objects and features will be in part apparent and in part pointed out hereinafter.

Briefly, a method of the present invention of making a wave dampening batt for use inside a waterbed mattress to dampen the propagation of waves along the upper surface of the mattress includes the step of intimately mixing a multiplicity of short, non-woven fibers of a first type and a multiplicity of short, non-woven thermal bonding fibers. The thermal bonding fibers have a melting point significantly below the melting point of the fibers of the first type. Next the multiplicity of fibers of the first type and the multiplicity of thermal bonding fibers are formed into an aggregate having a thickness generally the same as the desired thickness of the wave dampening batt. The temperature of the aggregate is raised throughout to a temperature at or above the melting point of the thermal bonding fibers but below the melting point of the fibers of the first type, so that at least part of the thermal bonding fibers throughout the aggregate melt at least partially to form a melted product, which has a tendency to accumulate at the intersections of touching fibers of the first type. The temperature of the aggregate is then lowered below the melting point of the thermal bonding fibers to form a solid product from the melted product to join the fibers of the first type together throughout the aggregate.

A waterbed mattress of the present invention includes a watertight, flexible shell having a length, width and thickness when inflated with water corresponding to that desired for the exterior of the waterbed mattress, and a wave dampening batt disposed inside the shell to dampen the propagation of waves along the upper surface of the shell when the shell is inflated with water. The batt is composed of a multiplicity of short, non-woven fibers which fibers define a multiplicity of passageways through the batt to permit water to flow therethrough between the top and bottom of the batt. The fibers are joined to each other throughout the batt by the solidified product of melted thermal bonding fibers.

A wave dampening batt of the present invention for use inside a waterbed mattress to dampen the propagation of waves along the upper surface of said mattress includes a multiplicity of short, non-woven, lobed fibers. The fibers are secured together to form a unitary block having a predetermined thickness, the unitary block being formed in such a manner as to generally retain its shape in water. The unitary block has an open structure formed by a multiplicity of passageways around the fibers so that water may pass through the block. The block has an average specific gravity such that the block floats in water. The block is compressible inside the waterbed mattress for shipment, and is resilient so as to recover a substantial portion of its original thickness after shipment, the resilience of the block being a function of the resilience of the fibers forming the block. The lobed fibers are more resilient than unlobed fibers of comparable size and denier.

A precursor of the present invention for a wave dampening batt includes a multiplicity of short, non-woven fibers of a first type, and a multiplicity of short, non-woven thermal bonding fibers having a melting point significantly below the melting point of the fibers of the first type. The fibers of the first type and the thermal bonding fibers are formed into a compressible and resilient aggregate having a predetermined thickness, the thermal bonding fibers being intimately mixed with the fibers of the first type throughout the aggregate. The aggregate has an open structure formed by a multiplicity of passageways around the fibers so that water may readily pass through the aggregate. The thermal bonding fibers have a chemical composition such that the melting and resolidification of the melted material from the thermal bonding fibers causes touching fibers of the first type to adhere to each other, whereby the raising of the temperature of the aggregate above the melting point of the thermal bonding fibers yet below the melting point of the fibers of the first type and the subsequent lowering of the temperature of the aggregate below the melting point of the thermal bonding fibers causes the fibers of the first type to adhere to each other to form a unitary mass having generally the same thickness as the precursor.

A wave dampening batt of the present invention for use inside a waterbed mattress includes a multiplicity of short, non-woven, hollow fibers, at least some of said hollow fibers being closed at each end to form a closed, hollow space therein. The fibers are secured together to form a unitary block, which block is formed in such a manner as to generally retain its shape in water. The unitary block has an open structure formed by a multiplicity of passageways around the fibers so that water may pass through the block. The block has an average specific gravity such that the block floats in water. The closed, hollow fibers provide buoyancy for the unitary block.

BRIEF DESCRIPTION OF THE DRAWINGS

In the drawings.

Similar reference characters indicate similar parts throughout the several views of the drawing.

DESCRIPTION OF THE PREFERRED EMBODIMENTS

Figure 2:
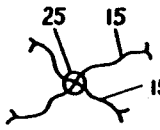
FIG. 2 is an elevation on an enlarged scale illustrating the joining of touching fibers in the batt of the present invention.

A garnetting machine 11 is commonly used to take a stream 13 of compacted unbound fibers of the desired type and from that input stream to make an output stream of such fibers having generally the thickness and width desired in a wave dampening batt for a waterbed mattress. By way of example, the input stream may consist of a multiplicity of relatively short, non-woven polyester fibers 15 (FIG. 2) which may be readily separated from each other. The garnetting machine 11 when used as taught in the prior art takes the input stream (from a hopper or the like, not shown) and expands it to the desired thickness (e.g., two inches) and the desired width (e.g., thirty-six inches).

In the present invention, on the other hand, garnetting machine 11 is supplied not only with stream 13 of polyester fibers 15, but also with a second stream 17 of thermal bonding fibers. These thermal bonding fibers are also polyester, but have a significantly lower melting point than do fibers 15. For example, fibers 15 may typically have a melting point of 450 to 475 degrees Fahrenheit, while the thermal bonding fibers may have a melting point of 250 to 325 degrees Fahrenheit. Since both types of fibers are polyester, this gives superior bonding (as described below) because of the chemically similar characteristics of the two types of fibers.

Figure 1:
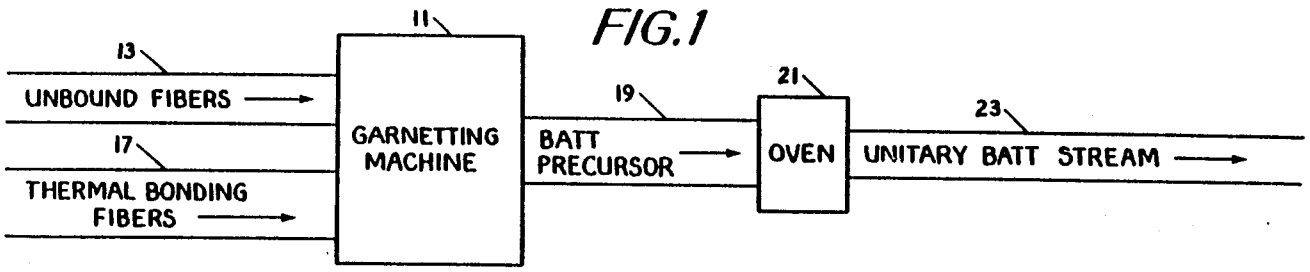
FIG. 1 is a block diagrammatic representation of the method of the present invention.

Although the thermal bonding fibers and fibers 15 are described as polyester, it should be realized that the only real requirements are that the thermal bonding fibers melt at a temperature significantly below the melting point of fibers 15, that the solidified product of the melted thermal bonding fibers adhere fibers !5 to each other, and that the materials be compatible with a waterbed mattress environment. It should also be realized that although garnetting machine 11 is shown in FIG. 1 as intimately mixing fibers 15 and the thermal bonding fibers, that mixing could be performed at an earlier stage in the process, in which case garnetting machine 11 would merely function to expand the mixed fiber stream to the desired size.

Figure 3:
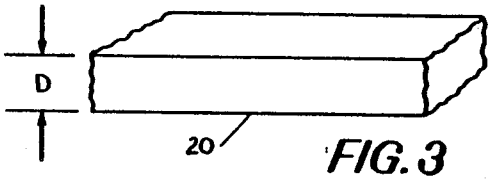
FIG. 3 is a perspective view of a segment of a stream of material before temperature processing in accordance with the present invention.

The output stream 19 of garnetting machine 11 is a precursor aggregate material 20 (FIG. 3) for a wave dampening batt for a waterbed mattress. It is of generally a desired width and thickness D (FIG. 3) for the finished batt, the length of the batt being determined by cutting the material at the end of the process to the desired length.

Output stream 19 is fed into an oven 21 or other suitable means for raising the temperature of the precursor aggregate material 20 to a temperature above the melting temperature of the thermal bonding fibers yet below the melting temperature of fibers 15. It should be realized that thermal bonding fibers come in two types. The first is made of a uniform material which completely melts when the melting point of the thermal bonding fibers is exceeded. The other has a core with a much higher melting point surrounded by a cladding of thermal bonding fiber material with the lower melting point. When the melting point of the thermal bonding fiber is referred to and the second type of thermal bonding fiber is being used, it is the melting point of the cladding which is being referenced.

Fibers 15 have sufficient structural strength so that the melting of thermal bonding fibers in oven 21 does not appreciably affect the thickness, D, of the stream. As the stream 23 exits from oven 21 it cools to below the melting point of the thermal bonding fibers and the material of those fibers resolidifies. When the thermal bonding fiber material was in the liquid state, however, it tended to accumulate at the points where any two fibers 15 were touching (see FIG. 2). When this material (labelled 25 in FIG. 2) solidifies, it joins or adheres those touching fibers firmly together. Since the thermal bonding fibers were intimately mixed with fibers 15 throughout the precursor material 20 of stream 19, this joining or adhering occurs throughout the thickness of the material.

Since the thermal bonding fibers join fibers 15 together throughout the thickness of the material in stream 23, there is no longer the two-inch limitation on the thickness of the resulting wave dampening batt imposed by the prior art resin-bonding systems. Batts of four inches, six inches, or even eight inches in thickness may readily be made as a unitary mass by the process described above.

Figure 4:
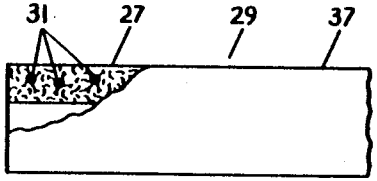
FIG. 4 is a side elevation, with parts broken away for clarity, of a waterbed mattress of the present invention.

As noted above, polyester fibers do not float, so if fibers 15 are polyester, it is necessary to provide some means for reducing the average specific gravity of a batt 27 (FIG. 4) or 27A (FIG. 5) made in accordance with the present invention so that the batt will float at the desired position (shown in FIG. 4) adjacent the top surface of a waterbed mattress 29. In FIG. 4, inclusions 31 such as polystyrene beads or EVA pieces have been added to batt 27 during the manufacturing process. Although not shown in FIG. 1, these inclusions may be mixed into the stream before oven 21, in which case the melting of the thermal bonding fibers tends to secure the inclusions in the unitary batt stream 23 as well.

Figure 5:
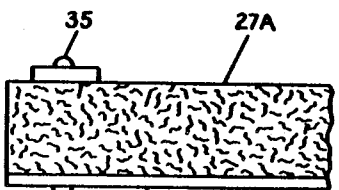
FIG. 5 is a side elevation, on an enlarged scale, of a portion of an alternative wave dampening batt of the present invention.

Alternatively a flotation layer 33 (FIG. 5 may be secured to batt 27A by a rivet 35 or the like to cause wave dampening batt 27A to float. In either case, the batt is inserted in a shell 37 (FIG. 4) which in use is filled with water to form waterbed mattress 29.

Figure 6:
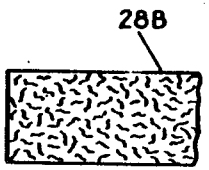
FIG. 6 is a side elevation of a portion of a second alternative wave dampening batt of the present invention.
Figure 8:
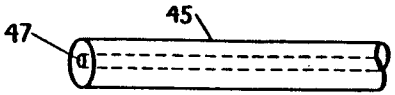
FIG. 8 is a simplified perspective view, on a greatly enlarged scale, of a hollow fiber from which the fiber of FIG. 7 is formed.
Figure 7:
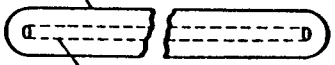
FIG. 7 is a simplified perspective view, on a greatly enlarged scale, of a hollow fiber with its ends sealed to form a closed, hollow space therein useful in the present invention.

As a second alternative, a batt 28B (FIG. 6) includes a multiplicity of fibers 43 (FIG. 7) which provide buoyancy to the batt. Fibers 43 are made from hollow, polyester fibers such as fiber 45 (FIG. 8) having a lumen 47 extending therethrough. Although fibers 43 and 45 (FIGS. 7 and 8) are shown as relatively straight and on an enlarged scale, it should be realized that this is solely from purposes of clarity. In actuality the fibers are twisted anD relatively short to provide resilience to the batt. Hollow fibers 45 (FIG. 8), since they are open at both ends, do not provide the needed buoyancy. It is necessary to close both ends of such a fiber 45 to form the fiber 43 (FIG. 7) having a closed, internal hollow space 49 inside the fiber. Closing the ends of fiber 45 to form 43 is accomplished by melting the fiber at both ends to close them off, such as by a hot wire or the like. Other means could of course be used to close the ends if desired.

A multiplicity of fibers 43 are joined together to form unitary batt 28B using the same method described above in connection with FIG. 1. In that case, fibers 43 constitute fibers 15. Alternatively, a mixture of hollow, closed end fibers 43 and solid-core fibers may be used, the proportion of hollow, closed end fibers 43 being selected to provide sufficient buoyancy to batt 28B.

For purposes of shipment, batt 27 is compressed in shell 37 when a vacuum is applied to the interior of waterbed mattress 29. This compresses the batt and tends to reduce the thickness, D, of the batt somewhat even when the mattress is inflated with water. It is known that an increased denier of fibers 15 will improve the resilience of batt 27 and hence its recovery of a good portion of its original thickness upon inflation.

Figure 9:
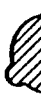
FIG. 9 is a sectional view on a greatly enlarged scale of tri-lobal fibers useful in the present invention.
Figure 10:
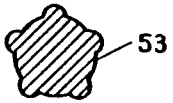
FIG. 10 is a sectional view on a greatly enlarged scale of penta-lobal fibers useful in the present invention.

It has been discovered that for a given denier and material a lobed fiber such as a tri-lobal fiber 51 (FIG. 9) or a penta-lobal fiber 53 (FIG. 10) used in place of fibers 15 greatly improves the recovery of batt 27 once the vacuum is removed because of the greater resilience of individual fibers 51 and 53 as compared with unlobed fibers 15. Lobed fibers such as fibers 51 and 53 are available from Eastman and Dupont, the Eastman tri-lobal fiber being sold under the trade designation tri-lateral type 417, for example.

Numerous variations of the present invention, within the scope of the appended claims, will be apparent to those skilled in the art in light of the foregoing description and accompanying drawings. These variations are merely illustrative.

Having thus described the invention, what is claimed and desired to be secured by Letters Patent is:

1. A method for making a wave dampening batt for use inside a waterbed mattress to dampen the propagation of waves along the upper surface of said mattress comprising:

intimately mixing a multiplicity of short, non-woven fibers of a first type and a multiplicity of short, non-woven thermal bonding fibers, said thermal bonding fibers having a melting point significantly below the melting point of the fibers of the first type, and expanding said multiplicity of fibers of the first type and said multiplicity of thermal bonding fibers into an aggregate having a thickness generally the same as the desired thickness of the wave dampening batt;

raising the temperature of said aggregate throughout to a temperature at or above the melting point of the thermal bonding fibers but below the melting point of the fibers of the first type, so that at least part of the thermal bonding fibers throughout the aggregate melt at least partially to form a melted product, said melted product having a tendency to accumulate at the intersections of touching fibers of the first type, said temperature raising step occurring without substantial compression of the aggregate so as to substantially maintain the desired thickness of the wave dampening batt; and lowering the temperature of said aggregate below the melting point of the thermal bonding fibers to form a solid product from the melted produce to join the fibers of the first type together throughout the aggregate, the thickness of the aggregate remaining substantially the same as the desired thickness of the wave dampening batt during the temperature lowering step.

2. The method as defined in claim 1 wherein the mixing and expanding step includes expanding the multiplicity of fibers of the first type and the multiplicity of fibers of the second type into an aggregate substantially greater than two inches in thickness.

3. The method as set forth in claim 1 wherein the mixing and expanding step includes mixing the multiplicity of short, non-woven thermal bonding fibers with a multiplicity or short, non-woven lobed fibers, said lobed fibers being the fibers of the first type.

4. The method as set forth in claim 1 wherein the aggregate substantially retains its thickness throughout the temperature raising and temperature lowering steps.

5. A wave dampening batt for use inside a waterbed mattress made in accordance with the method of claim 1.

6. The wave dampening batt as set forth in claim 5 wherein the wave dampening batt is substantially greater than two inches in thickness.

7. The wave dampening batt as set forth in claim 5 wherein the short, non-woven fibers are lobed fibers.

8. A wave dampening batt for use inside a waterbed mattress to dampen the propagation of waves along the upper surface of said mattress comprising:

a multiplicity of short, non-woven, lobed fibers, said fibers being secured together to form a unitary block having a predetermined thickness, said unitary block being formed in such a manner as to generally retain its shape in water, said unitary block having an open structure formed by a multiplicity of passageways around the fibers so that water may pass through the block, said block having an average specific gravity such that the block floats in water, said block being compressible inside the waterbed mattress for shipment, said block being resilient so as to recover a substantial portion of its original thickness after shipment, the resilience of the block being a function of the resilience of the fibers forming the block, said lobed fibers being more resilient than unlobed fibers of comparable size and denier.

9. The wave dampening batt as set forth in claim 8 wherein said lobed fibers are joined to each other throughout the batt by the solidified product of melted thermal bonding fibers.

10. The wave dampening batt as set forth in claim 8 wherein the short, non-woven, lobed fibers are polyester.

11. The wave dampening batt as set forth in claim 8 wherein the batt is substantially greater than two inches in thickness.

12. A waterbed mattress including the batt as defined in claim 8.

13. A precursor for a wave dampening batt, said batt to be used inside a waterbed mattress to dampen the propagation of waves along the upper surface of said mattress comprising:

a multiplicity of short, non-woven fibers of a first type;

a multiplicity of short, non-woven thermal bonding fibers having a melting point significantly below the melting point of the fibers of the first type;

said fibers of the first type and said thermal bonding fibers being expanded into a compressible and resilient aggregate having a predetermined thickness substantially the same as the desired thickness of the wave dampening batt to be made from the precursor, said thermal bonding fibers being intimately mixed with the fibers of the first type throughout the aggregate;

said aggregate having an open structure formed by a multiplicity of passageways around the fibers so that water may readily pass through the aggregate;

said thermal bonding fibers having a chemical composition such that the melting of the thermal bonding fibers to form a melt product and resolidification of the thermal bonding fibers melt product causes touching fibers of the first type to adhere to each other without substantially affecting the thickness of the aggregate so as to maintain the desired thickness of the wave dampening batt, whereby the raising of the temperature of the aggregate above the melting point of the thermal bonding fibers yet below the melting point of the fibers of the first type and the subsequent lowering of the temperature of the aggregate below the melting point of the thermal bonding fibers causes the fibers of the first type to adhere to each other to form a unitary mass having generally the same thickness as the precursor.

14. The precursor as set forth in claim 13 wherein the fibers of the first type are lobed fibers.

15. A wave dampening batt made from the precursor of claim 13.

16. The wave dampening batt as set forth in claim 15 in which said fibers of the first type are joined to each other throughout the batt by the solidified product of melted thermal bonding fibers.

17. A waterbed mattress comprising:

a watertight, flexible shell having a length, width and thickness when inflated with water corresponding to that desired for the exterior of the waterbed mattress; and a wave dampening batt disposed inside said shell to dampen the propagation of waves along the upper surface of the shell when the shell is inflated with water;

said batt being composed of a multiplicity of short, non-woven fibers, said fibers defining a multiplicity of passageways through the batt to permit water to flow therethrough between the top and bottom of the batt, at least some of said fibers having closed, hollow internal spaces to provide buoyancy for said batt.

18. The waterbed mattress as set forth in claim 17 wherein the short, non-woven fibers are polyester.

19. The waterbed mattress as set forth in claim 17 wherein the fibers are joined to each other throughout the batt by the solidified product of melted thermal bonding fibers.

20. A wave dampening batt for use inside a waterbed mattress to dampen the propagation of waves along the upper surface of said mattress comprising a multiplicity of short, non-woven, hollow fibers, at least some of said hollow fibers being closed at each end to form a closed, hollow space therein, said fibers being secured together to form a unitary block, said unitary block being formed in such a manner as to generally retain its shape in water, said unitary block having an open structure formed by a multiplicity of passageways around the fibers so that water may pass through the block, said block having an average specific gravity such that the block floats in water, said closed, hollow fibers providing buoyancy for said block.

21. The wave dampening batt as set forth in claim 20 wherein t-he short, non-woven, closed hollow fibers are polyester.

22. A waterbed mattress including the batt as defined in claim 20.

* * * * *